US010633924B2

(12) United States Patent
Haugvaldstad

(10) Patent No.: US 10,633,924 B2
(45) Date of Patent: Apr. 28, 2020

(54) DIRECTIONAL DRILLING STEERING ACTUATORS

(71) Applicant: Schlumberger Technology Corporation, Sugar Land, TX (US)

(72) Inventor: Kjell Haugvaldstad, Trondheim (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 79 days.

(21) Appl. No.: 15/574,425

(22) PCT Filed: May 19, 2016

(86) PCT No.: PCT/US2016/033180
§ 371 (c)(1),
(2) Date: Nov. 15, 2017

(87) PCT Pub. No.: WO2016/187373
PCT Pub. Date: Nov. 24, 2016

(65) Prior Publication Data

US 2018/0142520 A1 May 24, 2018

Related U.S. Application Data

(60) Provisional application No. 62/164,505, filed on May 20, 2015.

(51) Int. Cl.
*E21B 7/06* (2006.01)
*E21B 17/10* (2006.01)
(Continued)

(52) U.S. Cl.
CPC ..... *E21B 7/065* (2013.01); *E21B 7/04* (2013.01); *E21B 7/06* (2013.01); *E21B 7/062* (2013.01); *E21B 17/1014* (2013.01); *E21B 19/24* (2013.01)

(58) Field of Classification Search
CPC ... E21B 7/04; E21B 7/06; E21B 7/065; E21B 17/1014
See application file for complete search history.

(56) References Cited

U.S. PATENT DOCUMENTS 4,856,601 A * 8/1989 Raney ..... E21B 10/43 175/393
5,113,953 A 5/1992 Noble
(Continued)

FOREIGN PATENT DOCUMENTS

WO WO2012162833 A1 12/2012
WO WO2016187372 A1 11/2016

OTHER PUBLICATIONS

International Search Report and Written Opinion issued in International Patent application PCT/US2016/033180, dated Sep. 12, 2016. 14 pages.

(Continued)

*Primary Examiner* — Tara E Schimpf

(57) ABSTRACT

A rotary steerable drilling system having a series of actuators disposed with a drilling tool, the series of actuators arranged in close proximity and independently operable to distribute a total steering force applied to a wellbore wall across the series of actuators. The series of actuators are extendable to different distances, such that the radial extension length of the actuators increases between actuators.

20 Claims, 10 Drawing Sheets

(51) Int. Cl.
*E21B 19/24* (2006.01)
*E21B 7/04* (2006.01)

(56) References Cited

U.S. PATENT DOCUMENTS

| | | | | |
|---|---|---|---|---|
| 5,265,682 | A | 11/1993 | Russell et al. | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,971,085 | A | 10/1999 | Colebrook | |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |
| 6,257,356 | B1 * | 7/2001 | Wassell | E21B 7/06 166/66.5 |
| 6,364,034 | B1 | 4/2002 | Schoeffler | |
| 6,394,193 | B1 | 5/2002 | Askew | |
| 9,022,141 | B2 | 5/2015 | Panchal et al. | |
| 2001/0052428 | A1 | 12/2001 | Larronde et al. | |
| 2002/0011359 | A1 | 1/2002 | Webb et al. | |
| 2002/0179336 | A1 | 12/2002 | Schaaf et al. | |
| 2005/0056463 | A1 * | 3/2005 | Aronstam | E21B 7/062 175/61 |
| 2009/0044979 | A1 * | 2/2009 | Johnson | E21B 7/06 175/24 |
| 2011/0162890 | A1 | 7/2011 | Radovan | |
| 2015/0008045 | A1 | 1/2015 | Downton | |

OTHER PUBLICATIONS

International Preliminary Report on Patentability issued in International Patent Application PCT/US2016/033180 on Nov. 21, 2018. 11 pages.

* cited by examiner

DIRECTIONAL DRILLING STEERING ACTUATORS

CROSS-REFERENCE TO RELATED APPLICATIONS

The present application claims priority to and the benefit of U.S. Provisional Patent Application No. 62/164,505 entitled "DIRECTIONAL DRILLING STEERING ACTUATORS" and filed May 20, 2015, the disclosure of which is incorporated herein by reference.

BACKGROUND

This section provides background information to facilitate a better understanding of the various aspects of the disclosure. It should be understood that the statements in this section of this document are to be read in this light, and not as admissions of prior art.

In underground drilling, a drill bit is used to drill a borehole into subterranean formations. The drill bit is attached to sections of pipe that stretch back to the surface. The attached sections of pipe are called the drill string. The section of the drill string that is located near the bottom of the borehole is called the bottom hole assembly (BHA). The BHA typically includes the drill bit, sensors, batteries, telemetry devices, and other equipment located near the drill bit. A drilling fluid, called mud, is pumped from the surface to the drill bit through the pipe that forms the drill string. The primary functions of the mud are to cool the drill bit and carry drill cuttings away from the bottom of the borehole and up through the annulus between the drill pipe and the borehole.

Because of the high cost of setting up drilling rigs and equipment, it is desirable to be able to explore formations other than those located directly below the drilling rig, without having to move the rig or set up another rig. In off-shore drilling applications, the expense of drilling platforms makes directional drilling even more desirable. Directional drilling refers to the intentional deviation of a wellbore from a vertical path. A driller can drill to an underground target by pointing the drill bit in a desired drilling direction.

SUMMARY

In an embodiment, an actuator assembly includes a body, a first chamber in the body, a second chamber in the body, a first actuator positioned at least partially in the first chamber, a second actuator positioned at least partially in the second chamber. The body has a distal end and a proximal end with a longitudinal axis extending between. The body includes a wall with an outer surface at least partially oriented in a radial direction. The first chamber is formed in the wall and has an opening in the outer surface. The first actuator is positioned at least partially within the first chamber. The first actuator has a first working surface and is movable between an extended position and a retracted position. The first working surface is radially further from the longitudinal axis in the extended position than in the retracted position. The first actuator has a first extension length, wherein the first extension length is a distance from a radially outermost point of the first working surface in the extended position to the outer surface of the wall. The second chamber is formed in the wall and has an opening in the outer surface. The second actuator is positioned at least partially within the second chamber. The second actuator has a second working surface and is movable between an extended position and a retracted position. The second working surface is radially further from the longitudinal axis in the extended position than in the retracted position. The second actuator has a second extension length, wherein the second extension length is a distance from a radially outermost point of the second working surface in the extended position to the outer surface of the wall. The second extension length is greater than the first extension length.

In another embodiment, a rotary steerable system includes a body, a first fluid channel, a second fluid channel, and an actuator assembly. The actuator assembly includes a first chamber in the body, a second chamber in the body, a first actuator positioned at least partially in the first chamber, a second actuator positioned at least partially in the second chamber. The body has a distal end and a proximal end with a longitudinal axis extending between. The body includes a wall with an outer surface at least partially oriented in a radial direction transverse to the longitudinal axis. The first chamber is formed in the wall and has an opening in the outer surface. The first actuator is positioned at least partially within the first chamber. The first actuator has a first working surface and is movable between an extended position and a retracted position. The first working surface is radially further from the longitudinal axis in the extended position than in the retracted position. The first actuator has a first extension length, wherein the first extension length is a distance from a radially outermost point of the first working surface in the extended position to the outer surface of the wall. The second chamber is formed in the wall and has an opening in the outer surface. The second actuator is positioned at least partially within the second chamber. The second actuator has a second working surface and is movable between an extended position and a retracted position. The second working surface is radially further from the longitudinal axis in the extended position than in the retracted position. The second actuator has a second extension length, wherein the second extension length is a distance from a radially outermost point of the second working surface in the extended position to the outer surface of the wall. The second extension length is greater than the first extension length. The first fluid channel is in fluid communication with the first chamber, and the second fluid channel is in fluid communication with the second chamber.

In yet another embodiment, a method for steering a drilling system includes extending a first actuator a first radial distance and applying a first force to a formation. The method further includes extending a second actuator a second radial distance greater than the first radial distance and applying a second force to the formation.

This summary is provided to introduce a selection of concepts that are further described below in the detailed description. This summary is not intended to identify specific features of the claimed subject matter, nor is it intended to be used as an aid in limiting the scope of the claimed subject matter.

Additional features of embodiments of the disclosure will be set forth in the description which follows. The features of such embodiments may be realized by means of the instruments and combinations particularly pointed out in the appended claims. These and other features will become more fully apparent from the following description and appended claims, or may be learned by the practice of such embodiments as set forth herein.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 6-1 is a side view of an embodiment of an actuator, according to the present disclosure;

FIG. 6-2 is a top view of the embodiment of an actuator of FIG. 6-1, according to the present disclosure;

DETAILED DESCRIPTION

Figure 1:
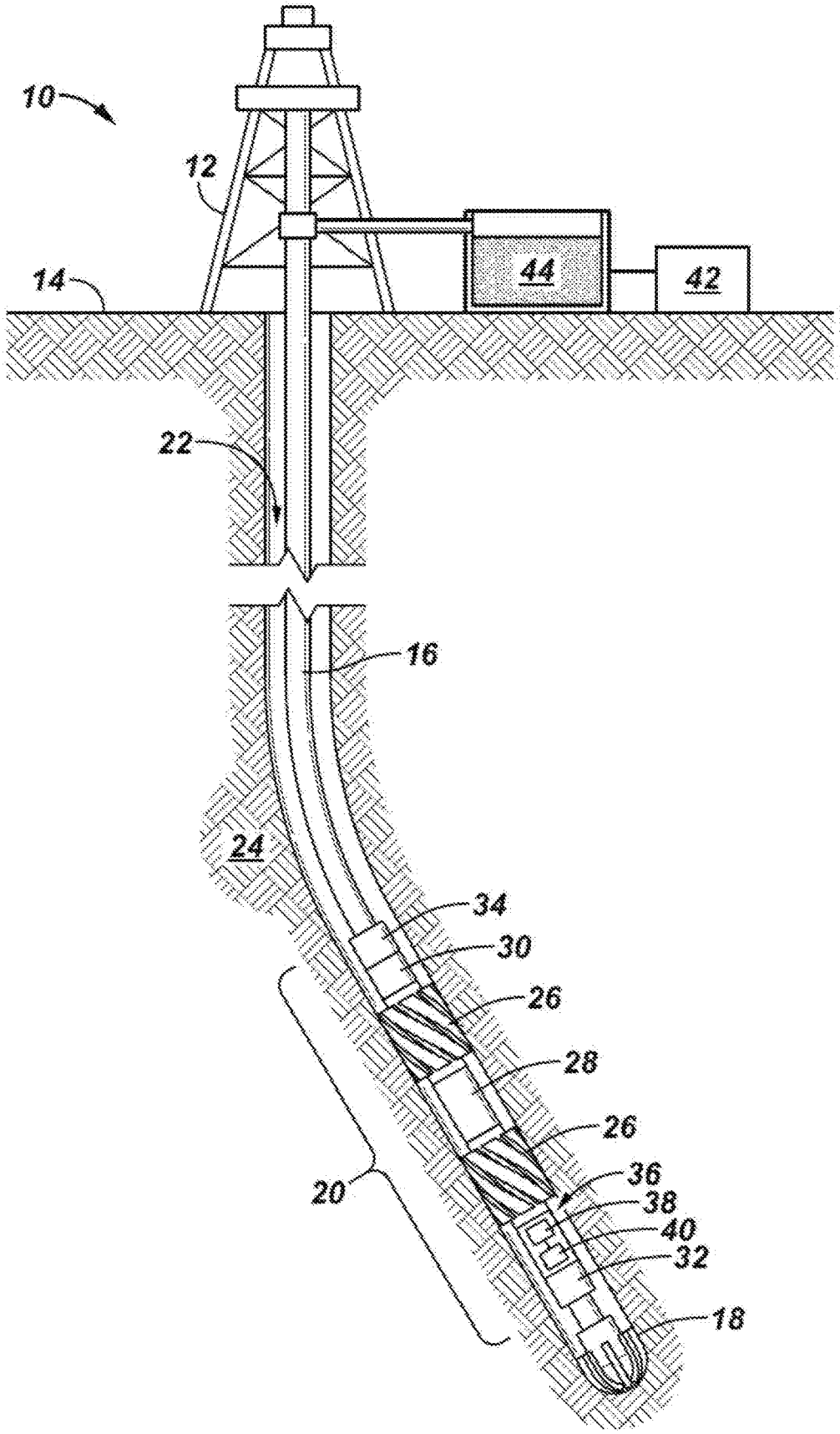
FIG. 1 is a schematic diagram of an embodiment of a directional drilling system with directional drilling actuator assembly, according to the present disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element may be utilized to more clearly describe some elements. Commonly, these terms relate to a reference point such as the surface from which drilling operations are initiated.

The directional drilling process creates geometric boreholes by steering a drilling tool along a planned path. A directional drilling system typically utilizes a steering assembly to steer the drill bit and to create the borehole along the desired path (i.e., trajectory). Steering assemblies may be classified generally, for example, as a push-the-bit or point-the-bit devices. Push-the-bit devices typically apply a side force on the formation to influence the change in orientation. A point-the-bit device typically has a fixed bend in the geometry of the bottom hole assembly. Rotary steerable systems ("RSS") provide the ability to change the direction of the propagation of the drill string and borehole while drilling.

According to one or more embodiments, control systems may be incorporated into the downhole system to stabilize the orientation of propagation of the borehole and to interface directly with the downhole sensors and/or actuators. For example, directional drilling devices (e.g., RSS and non-RSS devices) may be incorporated into the bottom hole assembly. Directional drilling may be positioned directly behind the drill bit in the drill string. According to one or more embodiments, directional drilling devices may include a control unit and bias unit. The control unit may include, for example, sensors in the form of accelerometers and/or magnetometers to determine the orientation of the tool and the propagating borehole, and processing and memory devices. The accelerometers and magnetometers may be referred to generally as measurement-while-drilling sensors. The bias unit may be referred to as the main actuation portion of the directional drilling tool and the bias unit may be categorized as a push-the-bit or point-the-bit actuators. The drilling tool may include a power generation device, for example, a turbine to convert the downhole flow of drilling fluid into electrical power.

Push-the-bit steering devices apply a side force to the formation through a stabilizer for example. This provides a lateral bias on the drill bit through bending in the borehole. Push-the-bit steering devices may include for example actuator pads. According to one embodiment, a motor in the control unit rotates a rotary valve that directs a portion of the flow of drilling fluid into actuator chambers. The differential pressure between the pressurized actuator chambers and the formation applies a force across the area of the pad to the formation. A rotary valve, for example, may direct the fluid flow into an actuator chamber to operate a pad and create the desired side force. In these systems, the tool may be continuously steering.

In point-the-bit steering devices the axis of the drill bit is at an angular offset to the axis of the bottom hole assembly. For example, the outer housing and the drill bit may be rotated from the surface and a motor may rotate in the opposite direction from the outer housing. A power generating device (e.g., turbine) may be disposed in the drilling fluid flow to generate electrical power to drive a motor. The control unit may be located behind the motor, with sensors that measure the attitude and control the tool face angle of the fixed bend.

FIG. 1 is a schematic illustration of an embodiment of a directional drilling system 10 in which embodiments of steering devices and steering actuators may be incorporated. The directional drilling system 10 includes a rig 12 located above a surface 14 and a drill string 16 suspended from the rig 12. A drill bit 18 disposed with a bottom hole assembly ("BHA") 20 and deployed on the drill string 16 to drill (i.e., propagate) a borehole 22 into a formation 24.

The depicted BHA 20 includes one or more stabilizers 26, a measurement-while-drilling ("MWD") module or sub 28, a logging-while-drilling ("LWD") module or sub 30, a steering system 32 (e.g., RSS device, steering actuator, actuators, pads), a power generation module or sub 34, or combinations thereof. The directional drilling system 10 includes an attitude hold controller 36 disposed with the BHA 20 and operationally connected with the steering system 32 to maintain the drill bit 18 and the BHA 20 on a desired drill attitude to propagate the borehole 22 along the desired path (i.e., target attitude). The depicted attitude hold controller 36 includes a downhole processor 38 and direction and inclination ("D&I") sensors 40, for example, accelerometers and magnetometers. According to an embodiment, the downhole attitude hold controller 36 is a closed-loop system that interfaces directly with the BHA 20 sensors (e.g., the D&I sensors 40, the MWD sub 28 sensors, and the steering system 32 to control the drill attitude). The attitude hold controller 36 may be, for example, a unit configured as a roll stabilized or a strap down control unit. Although embodiments are described primarily with reference to rotary steerable systems, it is recognized that embodiments may be utilized with non-RSS directional drilling tools. The directional drilling system 10 includes drilling fluid or mud 44 that can be circulated from the surface 14 through the axial bore of the drill string 16 and returned to the surface 14 through the annulus between the drill string 16 and the formation 24.

Figure 2:
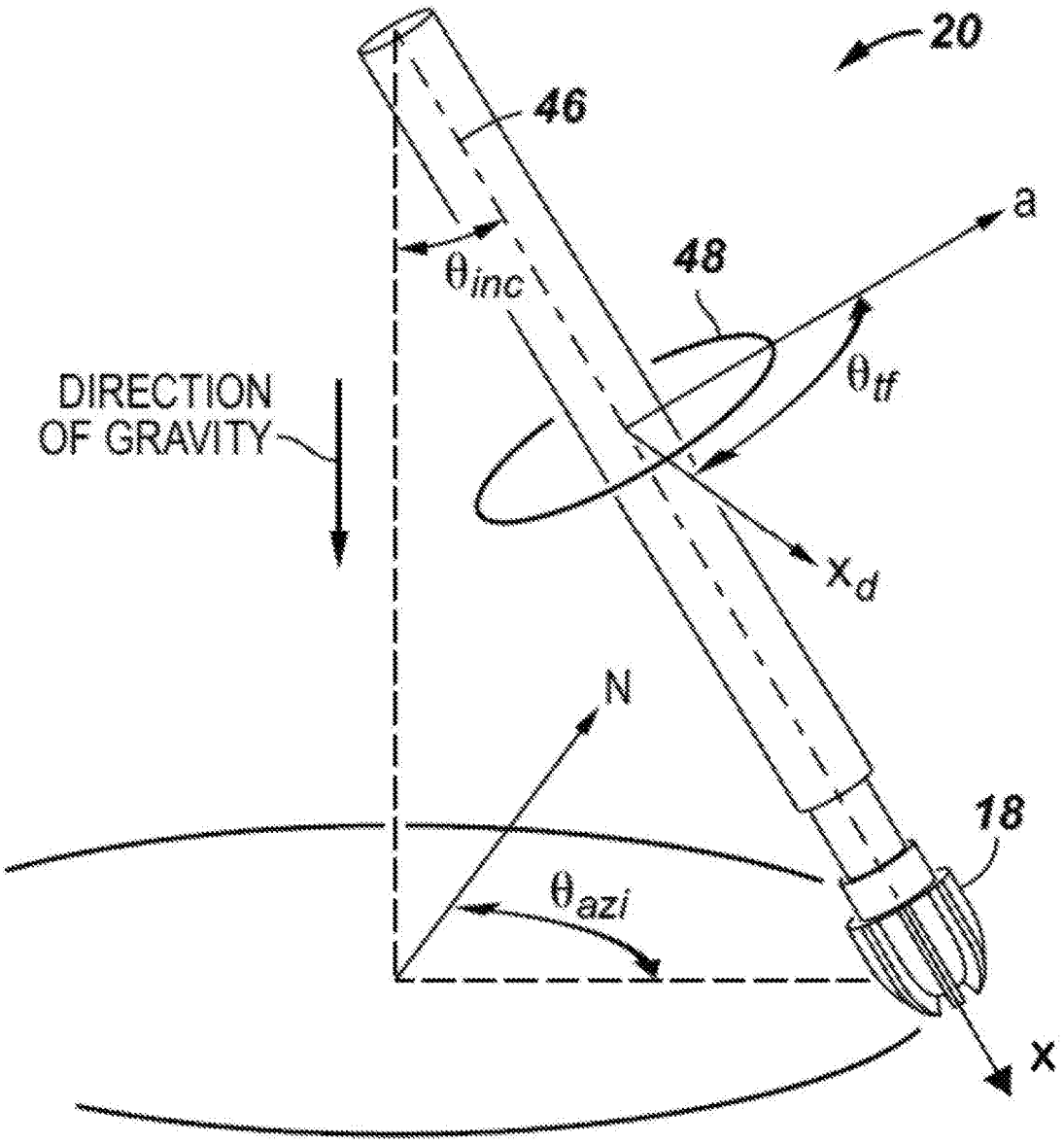
FIG. 2 is a pictorial diagram of attitude and steering parameters depicted in a global coordinate reference frame, according to the present disclosure.

The tool's attitude (e.g., drill attitude) is generally identified as the axis 46 of the BHA 20 for example in FIG. 2. Attitude commands may be inputted (i.e., transmitted) from a directional driller or trajectory controller generally identified as a surface controller 42 (e.g., processor) in the illustrated embodiment. Signals, such as the demand attitude commands, may be transmitted for example via mud pulse telemetry, wired pipe, acoustic telemetry, and wireless transmissions. Accordingly, upon directional inputs from the surface controller 42, the downhole attitude hold controller 36 controls the propagation of the borehole 22 through a downhole closed loop, for example by operating the steering system 32. In particular, the steering system 32 is actuated to drive the drill to a set point.

In the point-the-bit system, the axis of rotation of the drill bit 18 is deviated from the local axis 46 (e.g., FIG. 2) of the BHA 20 in the general direction of the new borehole 22. The borehole 22 is propagated in accordance with the customary three-point geometry defined by upper and lower stabilizer 26 contact points and the drill bit 18 contact point with the formation 24. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer.

In the push-the-bit rotary steerable system there is usually no specially identified mechanism to deviate the drill bit axis from the local bottom hole assembly axis; instead, the requisite non-collinear condition is achieved by causing either or both of the upper or lower stabilizers to apply an eccentric force or displacement in a direction that is preferentially orientated with respect to the direction of the borehole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points.

FIG. 2 illustrates attitude and steering parameters for a bottom hole assembly 20, identified by an axis 46, in a global or Earth reference frame coordinate system. The Earth reference frame is the inertial frame which is fixed and corresponds to the geology in which the borehole is being drilled and by convention is a right handed coordinate system with the x-axis pointing downhole and the y-axis pointing magnetically North. The attitude is the direction of propagation of the drill bit and represented by a unit vector for the downhole control systems. The instantaneous attitude "X" of the BHA 20 is indicated by the inclination $\theta_{inc}$ and azimuth $\theta_{azi}$ angles. The data from the BHA 20 (e.g., the D&I sensors 40) may be communicated to the surface controller 42 (e.g., the direction driller) for example via a low bandwidth (2 to 20 bits per second) mud pulse to identify the instantaneous inclination and azimuth and thus the attitude of the BHA 20. The tool face is identified by the numeral 48 and the tool face angle, $\theta_{tf}$, is the clockwise difference in angle between the projection of "a" in the tool face plane and the steering direction (i.e., target or demand attitude) "$x_d$" in the plane. The directional driller (e.g., the surface controller 42) communicates attitude reference signals to the downhole attitude hold controller 36 (e.g., the processor 38). The reference signals for example being a demand tool inclination and demand tool azimuth set points for the desired tool orientation in the Earth reference frame. For example, the steering system 32 (e.g., the tool face actuator) is operated to direct the drill bit along the desired attitude.

Figure 3:
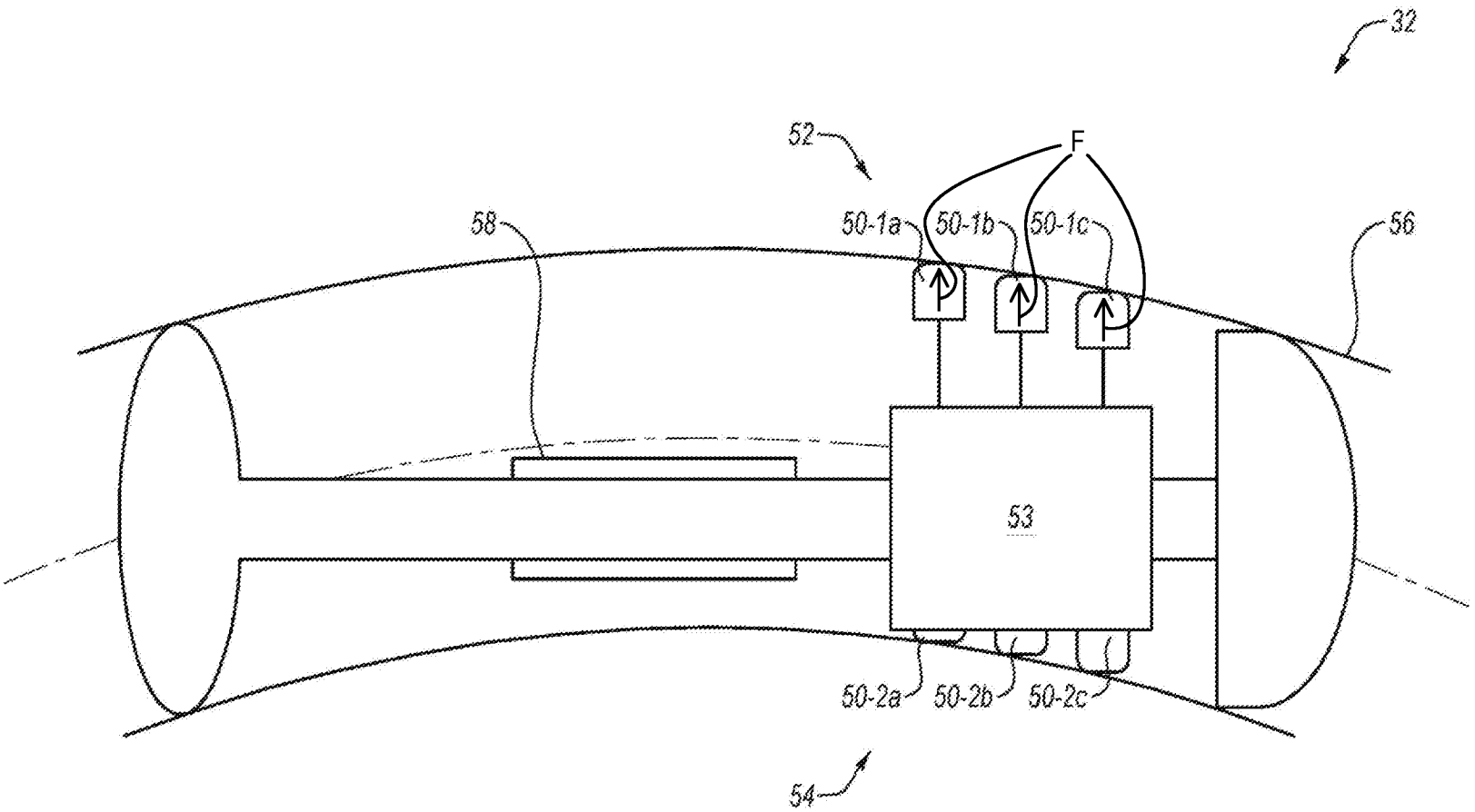
FIG. 3 is a schematic representation of an actuator assembly in a downhole environment, according to the present disclosure.

FIG. 3 illustrates a steering system 32 according to one or more embodiments. The steering system 32 (e.g., bias unit) includes steering actuators (e.g., actuators, pads) 50-1, 50-2, 50-3 arranged in cooperative actuator assembly 52 of two or more actuators that are located in proximity to one another. In some embodiments, two or more actuators may be actuated simultaneously. In other embodiments, at least one of the actuators may be actuated independently of the remaining actuators in the actuator assembly 52. Whether the actuators are actuated independently or simultaneously, the actuators may have different amounts of travel. In other words, the distance to which a surface of the actuators may extend from the bias body 53 and/or a longitudinal axis of the steering system 32 although the individual actuators of the series may have independent travel. FIG. 3 illustrates two actuator assemblies 52, 54. The first actuator assembly 52 includes a series of actuators 50-1*a*, 50-1*b*, and 50-1*c* and the second actuator assembly 54 includes a series of actuators 50-2*a*, 50-2*b*, and 50-2*c*.

In some embodiments, each actuator assembly 52, 54 may be operated simultaneously by mud flow directed from control valve 58; as such the series of individual actuators operate as a whole. For example, control valve 58 may be opened to direct fluid flow to the first actuator assembly 52 thereby radially extending the actuators 50-1*a*, 50-1*b*, and 50-1*c*. Each individual actuator may have travel independent of the travel of the other actuators of the series, thus, the series of actuators, as a whole, contact the wellbore wall 56 and each actuator of the series may apply the actuator force to the wellbore wall. In other embodiments, each actuator of the actuator assemblies 52, 54 may be operated independently. For example, the control valve 58 may direct fluid flow to one or more of the actuators 50-1*a*, 50-1*b*, 50-1*c* of the first actuator assembly 52 to move the actuators 50-1*a*, 50-1*b*, 50-1*c* independently of one another. In other examples, only some of the actuators 50-1*a*, 50-1*b*, 50-1*c* may be moved by fluid pressure against the actuator and other actuators may be moved by electric motors, by one or more mechanical linkages, by other hydraulic systems, or combinations thereof. For example, the first actuator 50-1*a* and second actuator 50-1*b* may be hydraulically actuated and the third actuator 50-1*c* may be electronically actuated.

In the illustrated example, the actuators in the same series, such as actuators 50-1*a*, 50-1*b*, 50-1*c* of the first actuator assembly 52, are spaced axially apart and in close proximity to one another. In some embodiments, the actuators may be spaced apart by a distance less than or equal to the longitudinal dimension of the actuator. For example, actuators with a 5 cm longitudinal dimension may be positioned 5 cm or less from one another. Being positioned in close proximity, the series of actuators 50-1*a*, 50-1*b*, 50-1*c* together may form a larger actuator pad surface to contact the wellbore wall 56 than the surface of the individual actuators 50 operating separately. In addition, the actuators 50-1*a*, 50-1*b*, 50-1*c* can conform to the curvature of the wellbore wall 56 and thus have a larger surface area in contact with the wellbore wall 56 than a single actuator having a similar size pad surface area. For example, a flat surfaced single actuator may only have edge contact (e.g., one of the edges of the actuator) with the wellbore wall 56 while a plurality of actuators may each have edge contact with the wellbore wall 56. Thus, for two actuators, the contact with the wellbore wall 56 may be double, while for three actuators, the contact with the wellbore wall 56 may triple. For purposes of description, each series of actuators acts to form a single actuator assembly that is morphable to substantially conform to the curvature of the wellbore wall 56. The total actuator force shown by the arrows "F" applied via the series of actuators is better distributed against the wellbore wall 56 as compared to a one-element actuator.

By including multiple smaller actuators with independent travel (but driven by mud from the same valve opening) the contact pressure (total actuator area in contact with the wellbore divided by the total steering force) can be reduced. The smaller actuators 50-1*a*, 50-1*b*, 50-1*c* can have different travel ranges and with a shaped front face to reduce and/or minimize underreaming, as described in more detail in relation to FIG. 7 through FIG. 9. Push-type steering actuators will, if the actuation force (defined by the actuator area and the differential pressure across the actuator) is high enough, tend to underream the hole as it was drilled by the preceding drill bit.

Figure 4:
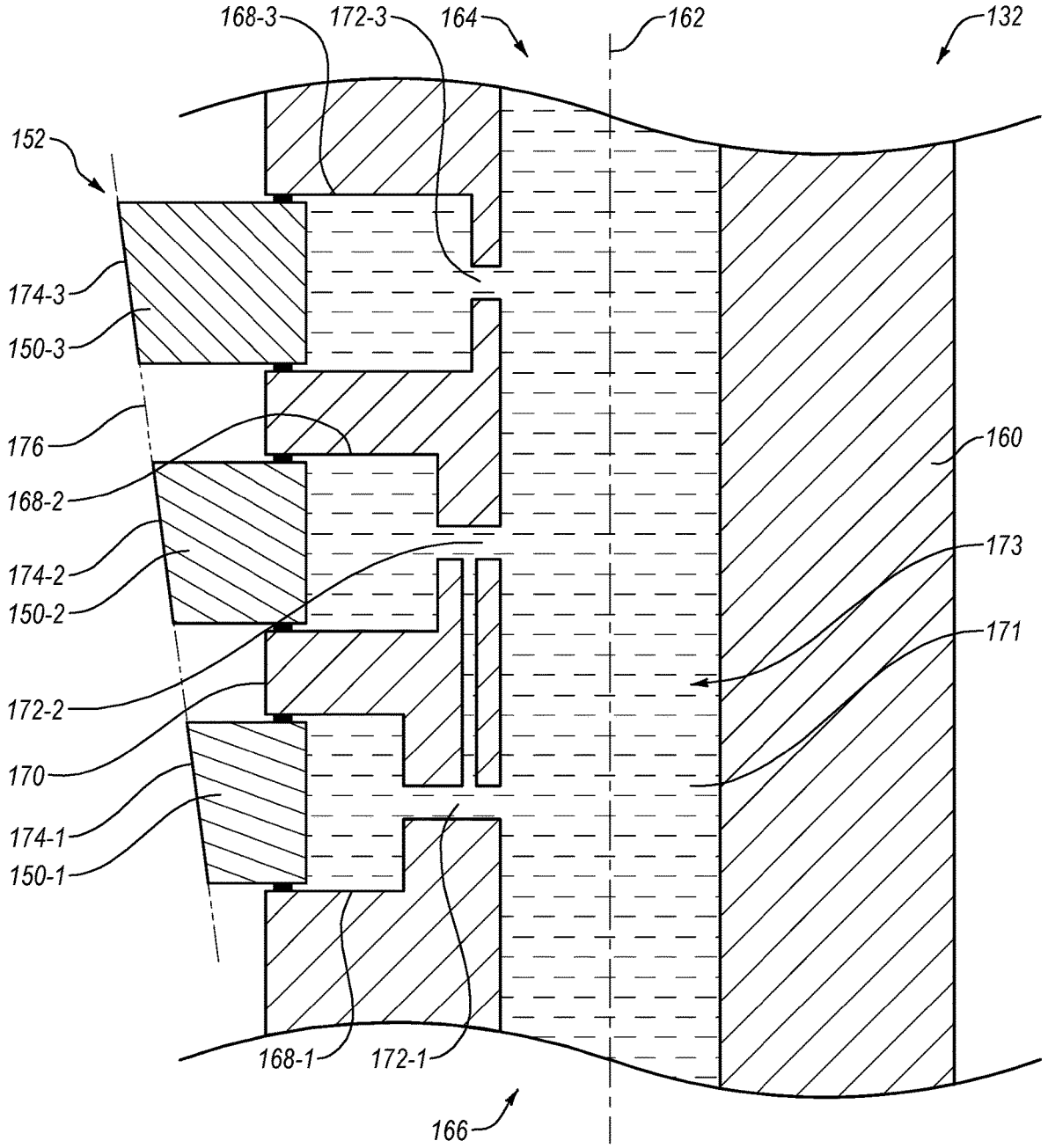
FIG. 4 is a cross-sectional view of an embodiment of an actuator assembly in a directional drilling system in an extended position, according to the present disclosure.

As shown in FIG. 4, a steering system 132 may have a body 160 with a longitudinal axis 162 therethrough. The longitudinal axis 162 may extend from a proximal end 164 (e.g. uphole end) toward a distal end 166 (e.g., downhole end).

The steering system 132 includes an actuator assembly 152 with a plurality of actuators therein. In the depicted embodiment, the actuator assembly 152 has a first actuator 150-1, a second actuator 150-2, and a third actuator 150-3, but in other embodiments, the actuator assembly 152 may have other quantities. For example, an actuator assembly 152 may have two actuators. In other examples, an actuator assembly 152 may have three, four, five, six, or more than six actuators in series. It should be understood that while the actuators are described herein as being in series, the actuators may be aligned in any fashion that allows force to be distributed amongst the actuators to provide a net directional force against a wellbore wall and steer the steering system 132. For example, the actuators may be axially aligned (e.g., aligned along a longitudinal axis of the BHA) and/or circumferentially aligned (e.g., aligned about a circumference of the BHA). In other examples, the actuators may be aligned along a line around a body 160 of the steering system 132. For instance, the line may spiral around the body 160.

The actuators 150-1, 150-2, 150-3 may each be positioned in a chamber 168-1, 168-2, 168-3, respectively, and may be configured to move at least partially radially within the chambers 168-1, 168-2, 168-3. For example, first actuator 150-1 may be positioned in a first chamber 168-1 and configured to move radially (e.g., away from) relative to the longitudinal axis 162 within the first chamber 168-1. In other embodiments, a plurality of actuators may be positioned in a single chamber such that the plurality of actuators are adjacent one another.

The chambers are formed in the body 160 of the steering system 132 and have an opening in an outer surface 170 of the body 160. In a fluid operated embodiment, such as shown in FIG. 4, a chamber (e.g., first chamber 168-1) has fluid 171 therein to provide a fluid pressure to move an actuator (e.g., first actuator 150-1). The first chamber 168-1 may be in fluid communication with a first channel 172-1, which may be in fluid communication with a main channel 173. The main channel 173 may provide a drilling fluid to the steering system 132 to apply a fluid pressure thereto. In other embodiments, the first channel 172-1 may be in fluid communication with a hydraulic reservoir and the fluid 171 may be a hydraulic fluid that is separate from a drilling fluid. In some embodiments, each actuator and chamber may be actuated by a separate fluid channel. For example, the second chamber 168-2 may be in fluid communication with a second fluid channel 172-2, and the third chamber 168-3 may be in fluid communication with a third fluid channel 172-3. In other embodiments, at least two of the chambers may be in fluid communication with each other, such as the first chamber 168-1 and the second chamber 168-2 as shown in FIG. 4. Chambers that are in fluid communication with one another may allow for simultaneous actuation of the actuators positioned therein. For example, the chambers in fluid communication may experience equal fluid pressure therein. In other embodiments, one or more of the actuators may be actuated at different times from one another. For example, one or more valves may limit or prevent fluid flow to the first chamber 168-1, while fluid pressure increases in another the second chamber 168-2, actuating the second actuator 150-2 before the first actuator 150-1.

The different actuators may have extended positions, as shown in FIG. 4, wherein the extended position for at least one of the actuators is radially farther (e.g., away) from the longitudinal axis 162 than the extended position of another actuator. Each of the actuators 150-1, 150-2, 150-3 may have a working surface 174-1, 174-2, 174-3 respectively, that is configured to contact a wellbore wall and apply a lateral (e.g., radial) force thereto. The extended positions of the actuators may be configured such that the radially outermost point (e.g., the top left corner on the page in FIG. 4) of the working surface of an uphole actuator (i.e., an actuator closer to the proximal end 164 of the steering system 132) may be further from the longitudinal axis 162 than the radially outermost point of a working surface of a downhole actuator (i.e., an actuator closer to the distal end 166 of the steering system 132). For example, the radially outermost point of the second working surface 174-2 of the second actuator 150-2 is further from the longitudinal axis 162 that the radially outermost point of the first working surface 174-1.

The distance between the radially outermost point of a working surface and the longitudinal axis 162 is the extension length of the actuator. In some embodiments, the extension length of each actuator (an uphole actuator) may be greater than another actuator (a downhole actuator) downhole from the uphole actuator. For example, the extension length of the first actuator 150-1 is less than the extension length of the second actuator 150-2 in FIG. 4. The extension length of the third actuator 150-3 is greater than the extension length of the second actuator 150-2 in FIG. 4.

In some embodiments, substantially all of the working surface of an uphole actuator is radially further from the longitudinal axis 162 than all of the working surface of a downhole actuator. For example, all of the second working surface 174-2 is radially further from the longitudinal axis 162 than all of the first working surface 174-1. All of the third working surface 174-3 is radially further from the longitudinal axis 162 than all of the second working surface 174-2. In other words, the radially innermost point (e.g., the bottom left corner) of the second working surface 174-2 is radially further from the longitudinal axis 162 than the radially outermost point of the first working surface 174-2.

In some embodiments, one or more of the working surfaces 174-1, 174-2, 174-3 may have a profile that is sloped radially inward in a distal direction (e.g., away from the drilling rig 12). In other embodiments, one or more of the working surfaces 174-1, 174-2, 174-3 may have a profile that is parallel to the longitudinal axis 162. In yet other embodiments, one or more of the working surfaces 174-1, 174-2, 174-3 may have a profile that is convex relative to the longitudinal axis 162.

The increasing extension distances of each actuator in the uphole direction may allow the working surfaces of the respective actuators to approximate and/or form a sloped surface 176 that extends along the working surfaces 174-1, 174-2, 174-3 of the actuators 150-1, 150-2, 150-3. The surface 176 (e.g. a plane) may slope radially inward in the distal direction. The surface 176 may allow the uphole actuators to engage with and apply a force to the wellbore wall even if a downhole actuator removes material from the wellbore, widening the walls of the wellbore.

Figure 5:
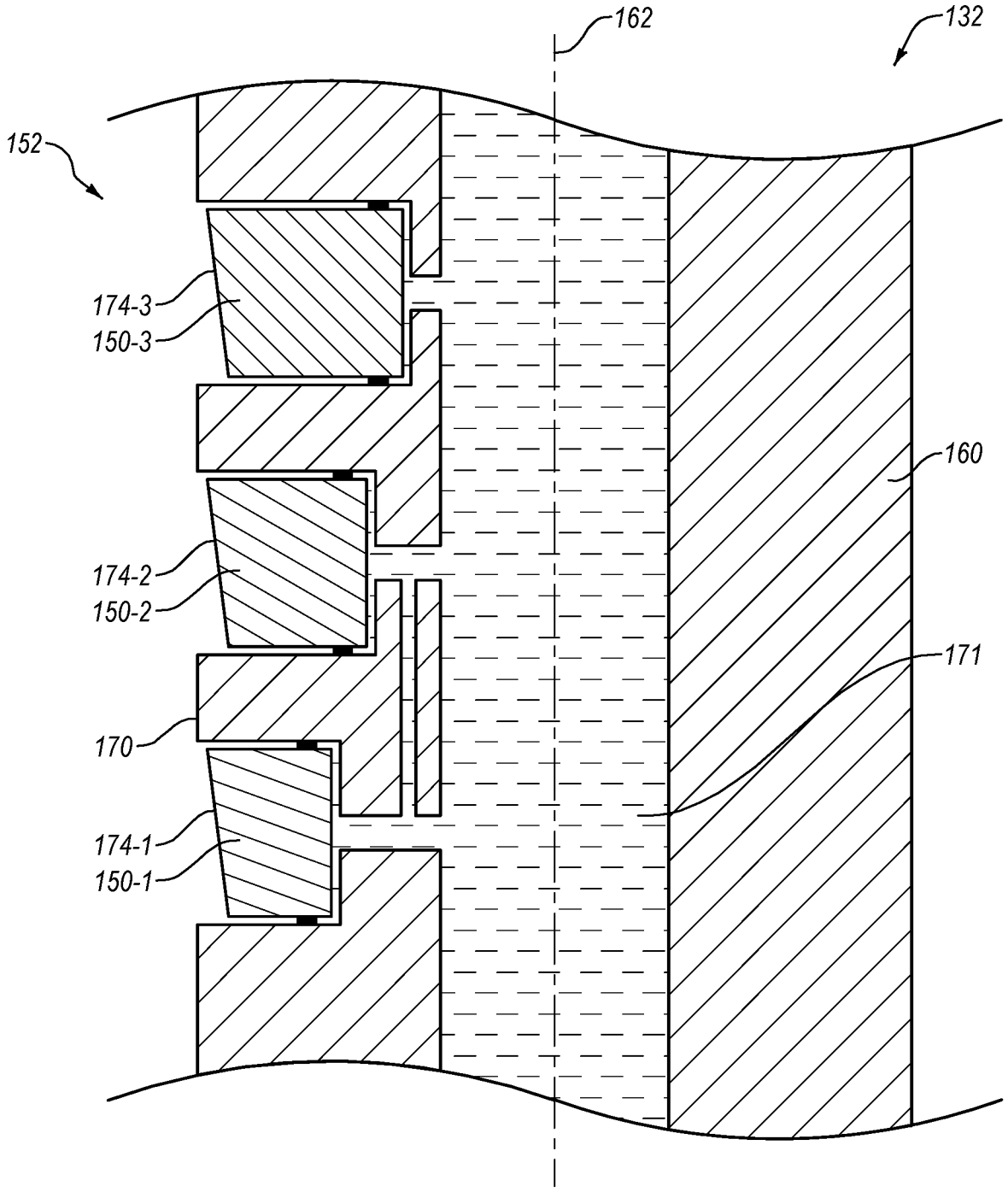
FIG. 5 is a cross-sectional view of the embodiment of an actuator assembly of FIG. 4 in a retracted position.

FIG. 5 illustrates the actuator assembly 152 with the actuators 150-1, 150-2, 150-3 in retracted positions. In the retracted positions, the actuators 150-1, 150-2, 150-3 are radially inward toward the longitudinal axis 162. In some embodiments, the actuators 150-1, 150-2, 150-3 may be biased inward toward the longitudinal axis 162, and hence toward the retracted position, by a spring, a bar, a compressed fluid piston, or other biasing mechanism. In other embodiments, the actuators 150-1, 150-2, 150-3 may be moved toward the retracted position by a negative pressure differential across the actuators 150-1, 150-2, 150-3 by changing the pressure of the fluid 171 in contact with the actuators 150-1, 150-2, 150-3.

In some embodiments, all of the working surface of an actuator may be recessed into the body 160 of the steering system 132 when the actuator is in a retracted position. For example, all of the first working surface 174-1 of the first actuator 150-1 may be recessed below the outer surface 170 of the body 160 when the first actuator 150-1 in the retracted position. In at least one embodiment, all of the working surfaces 174-1, 174-2, 174-3 of the actuators 150-1, 150-2, 150-3 of an actuator assembly 152 may be recessed within the body 160 and/or recessed below the outer surface 170 of the body 160.

In some embodiments, the body 160 may be a bit body. In other embodiments, the body 160 of the steering system may be a standalone downhole tool. In yet other embodiments, the body 160 may be another downhole tool including any of calipers, reamers, shock absorbers, jars, clamps, tractors, stabilizers, fishing tools, or other downhole tools.

Figures 1, 6:
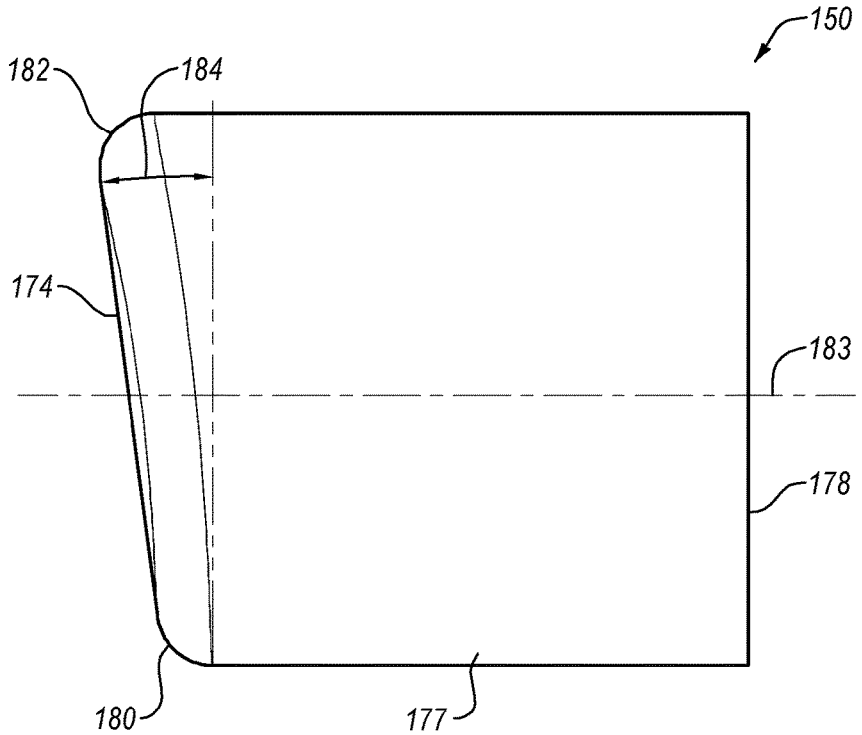
Figures 2, 6:
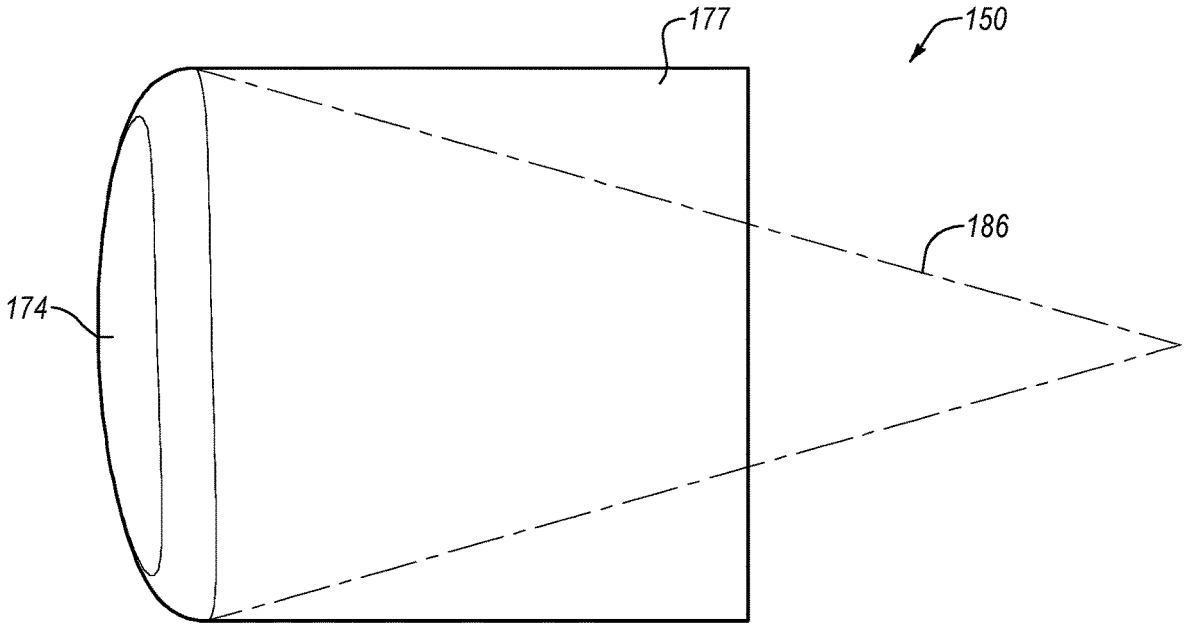

FIG. 6-1 is a side view of an embodiment of an actuator 150. The actuator 150 has an actuator body 177 with a working surface 174, as described herein, and an opposing base surface 178. The working surface 174 has a leading edge 180 and a trailing edge 182. The leading edge 180 may be oriented in the downhole (e.g., away from the drilling rig) direction when the actuator is positioned in a steering system, such as steering system 132 described in relation to FIG. 4 and FIG. 5. In some embodiments, the leading edge 180 may be rounded, chamfered, curved, or otherwise tapered from the working surface 174 toward the actuator body 177. A tapered leading edge 180 may reduce the underreaming effects of contact between the working surface and a wellbore wall by gradually contacting and/or compressing the wellbore. In contrast, a sharp or discontinuous leading edge 180 may allow a side of the actuator to contact the wellbore wall and removal material therefrom. In some embodiments, the trailing edge 182 may be rounded, chamfered, curved, or otherwise tapered from the working surface 174 toward the actuator body 177. A tapered trailing edge 182 may reduce the underreaming effects of contact between the working surface and a wellbore wall. For example, a sharp or continuous trailing edge 182 may generate a more rapid decompression of the formation as force is removed from the wellbore wall, increasing the probability that material will tear-out or be otherwise removed from the wellbore wall.

In some embodiments, the working surface 174 may be sloped relative to an axis 183 of the actuator body 177. For example, the axis 183 of the actuator body 177 may be the direction in which the actuator 150 moves relative to the body 160 of the steering system 132 shown in FIG. 4 and FIG. 5. Referring again to FIG. 6-1, the working surface 174 may be sloped from perpendicular relative to the axis 183 of the actuator body 177 such that at least a portion of the working surface 174 may be oriented at an angle 184 in a range having an upper value, a lower value, or upper and lower values including any of 1°, 2°, 3°, 4°, 6°, 8°, 10°, 12°, 14°, 16°, 18°, 20°, 30°, 45° or any values therebetween. For example, the working surface 174 may be oriented at an angle 184 between 1° and 30°. In another example, the working surface 174 may be oriented at an angle 184 in a range of 1° to 20°. In yet another example, the working surface 174 may be oriented at an angle 184 in a range of 2° to 15°. In a further example, the working surface 174 may be oriented at an angle 184 in a range of 3° to 12°. In at least one example, the working surface 174 may be oriented at an angle 184 of 6°. Further examples of working surfaces 174 may be found in U.S. Provisional Application No. 62/320,059 filed Apr. 8, 2016, which is hereby incorporated by reference in its entirety.

In some embodiments, the entire working surface 174 may be tapered. In other embodiments, less than the entire working surface 174 may be tapered. For example, half of the working surface 174 may be tapered while the other half of the working surface 174 may be parallel to the longitudinal axis.

FIG. 6-2 illustrates a top view of the actuator 150 of FIG. 6-1. The working surface 174 may have a curvature such that the working surface 174 is convex relative to the actuator body 177. The radius of curvature 186 of the working surface 174 may be constant. In other embodiments, the radius of curvature 186 may vary across the working surface 174. In yet other embodiments, the radius of curvature 186 may be constant on part of the working surface 174 and vary elsewhere on the working surface 174.

In some embodiments, the radius of curvature 186 of the actuator 150 may be substantially equivalent to the radius of the wall of the wellbore in which the actuator is used. For example, based on a cutting profile of [the drill bit], the radius of curvature 186 of one or more actuators 150 may be matched to the expected radius of the wall of the wellbore. In other embodiments, the radius of curvature 186 may be less than the radius of the wall of the wellbore, such that the sides of the working surface are "raised" relative to the wellbore wall as the actuator moves during rotation of the steering system.

Figure 7:
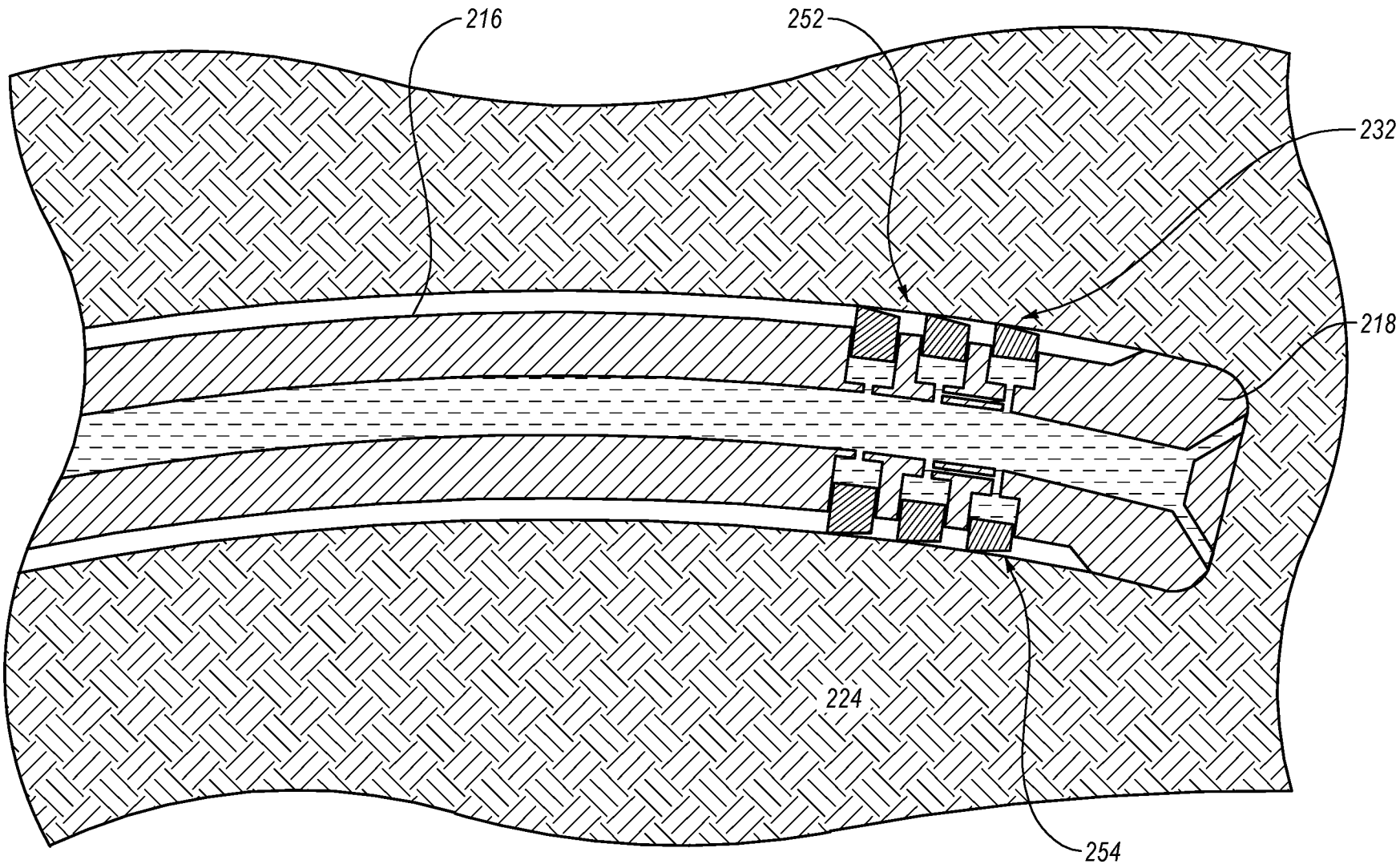
FIG. 7 illustrates a cross-sectional view of a wellbore with an embodiment of a rotary steerable system, according to the present disclosure.

An example of a steering system 232 according to the present disclosure is shown in FIG. 7 steering a bit 218 in a formation 224. The steering system 232 includes a first actuator assembly 252 and a second actuator assembly 254. The first actuator assembly 252 and the second actuator assembly 254 are shown as being radially opposed (e.g., mirrored about the longitudinal axis) to one another. In other embodiments, the first actuator assembly 252 and second actuator assembly 254 may be positioned at different orientations relative to one another (e.g., may be radially and/or circumferentially offset), such as in an embodiment having more than two actuator assemblies. The steering system 232 is part of a drill string 216 that is urged through the formation to cut a wellbore with the bit 218. The steering system 232 may apply an imbalanced force to the formation 224 laterally relative to drill string 216 to deflect the bit 218, as described in relation to FIG. 2. FIG. 7 illustrates the first actuator assembly 252 applying a force to the formation 224 with the first actuator assembly in a partially extended position (i.e., at least one actuator is positioned between the retracted position and the extended position). The second actuator assembly 254 may be in a partially extended position and applying less force to the formation 224.

Figure 8:
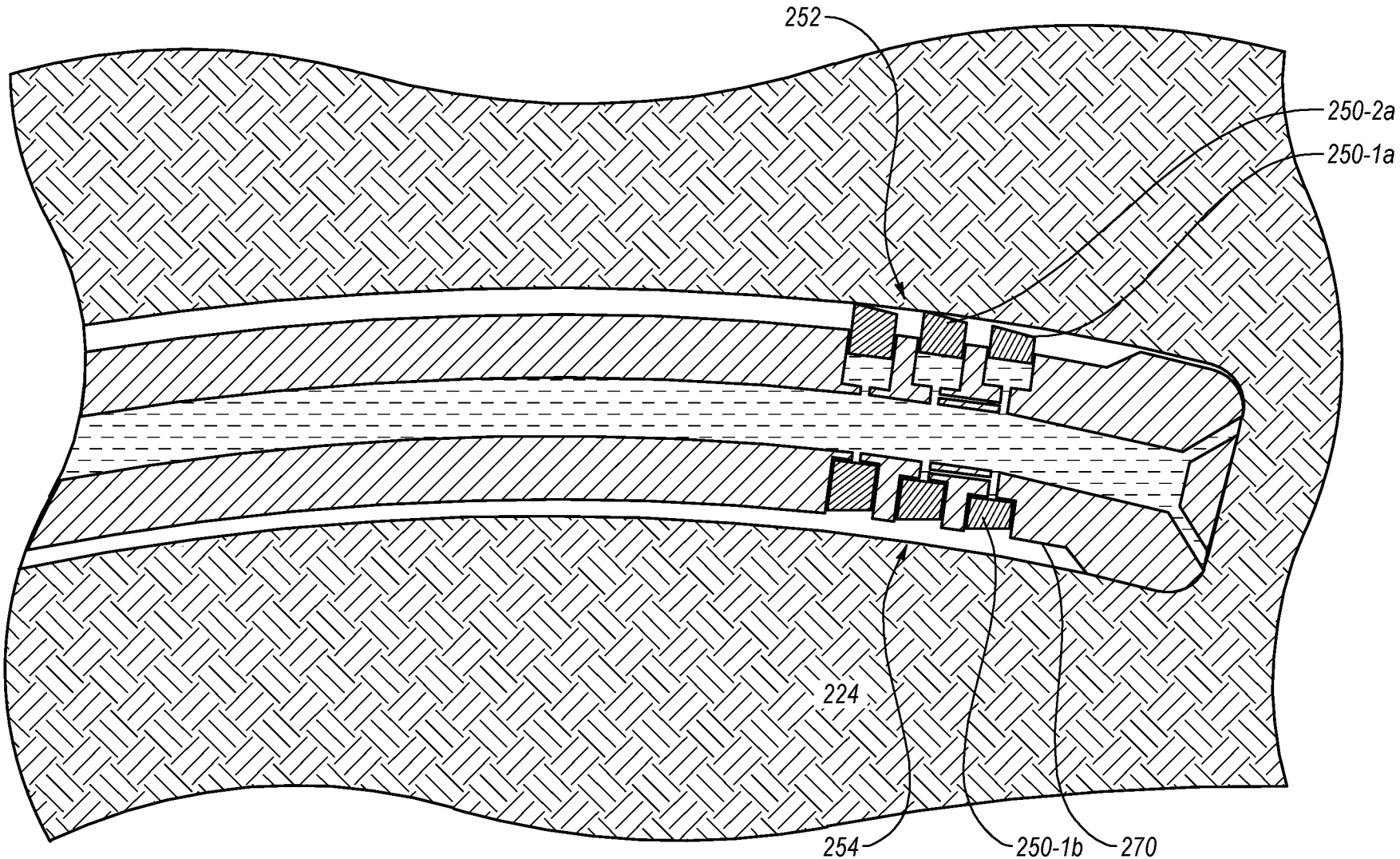
FIG. 8 illustrates a cross-sectional view of a wellbore with the embodiment of a rotary steerable system of FIG. 7 at a smaller turning radius, according to the present disclosure.

In some embodiments, the first actuator assembly 252 may be at least partially extended and applying a force to the formation 224 and the second actuator assembly 254 may be in a retracted position below the outer surface 270, such as shown in FIG. 8. The first actuator assembly 252 may be at least partially extended. For example, the first actuator 250-1*a* may be in the extended position, and the second actuator 250-2*a* may be less than fully extended. The second actuator assembly 254 may be in a retracted position, such that the first actuator 250-1*b* does not contact the formation 224, allowing for a smaller turning radius (i.e., a greater rate of deflection) of the drilling system through the formation 224.

Figure 9:
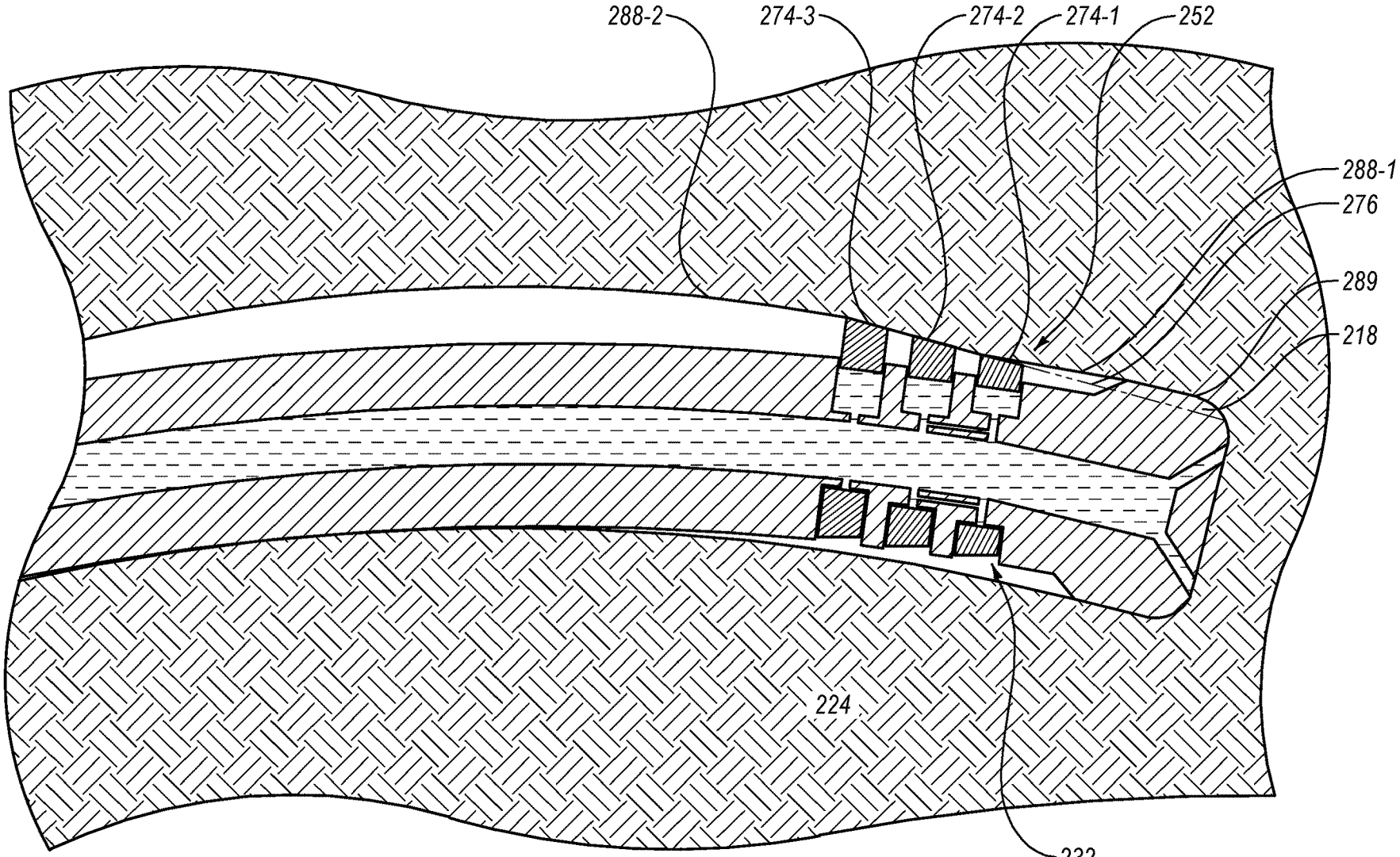
FIG. 9 illustrates a cross-sectional view of a wellbore with the embodiment of a rotary steerable system of FIG. 7 in a soft formation, according to the present disclosure.

Referring now to FIG. 9, an embodiment of the first actuator assembly 252 applying a force to a softer portion of the formation 224 is illustrated. The formation 224 may have varying compositions, or the formation 224 may be entirely formed of a comparatively soft earthen material, such as shale or unconsolidated conglomerate. In such embodiments, the first working surface 274-1 may apply a force to the formation 224 and may remove material from the formation 224, compress material in the formation 224, or combinations thereof. The removal and/or movement of material in the formation 224 may result in the wall 288-1 of the wellbore cut by the bit 218 moving radially away from the steering system 232. As described herein, a radially outermost point of the second working surface 274-2 may be extended radially further than the first working surface 274-1, so the second working surface 274-2 can contact the formation 224 and apply a force thereto, even if the first working surface 274-1 moved the wall of the wellbore radially away from the steering system 232. The wall 288-2 of the wellbore may increase is a transverse dimension after the first actuator assembly 252 applies a force to the formation 224 relative to the transverse dimension of the wall 288-1 before the first actuator assembly 252.

In some formations, the composition of the formation 224 may vary as the drilling system drills through the formation 224, and the first working surface 274-1 may contact a softer material than the second working surface 274-2, such as at a formation boundary or in heterogeneous formations. In such examples, the first working surface 274-1 may displace material from the formation 224 more readily than the second working surface 274-2, and the first working surface 274-1 may extend more than the second working surface 274-2.

As described herein, the working surfaces 274-1, 274-2, 274-3 may substantially align in a shared plane 276 when in the extended position. In some embodiments, such as that shown in FIG. 9, the working surfaces 274-1, 274-2, 274-3 may all contact the formation 224 to distribute a contact force (i.e., the steering force) across the working surfaces 274-1, 274-2, 274-3. Distributing the contact force may lower the pressure at a given location on the working surfaces 274-1, 274-2, 274-3, further reducing the removal and/or movement of material of the formation 224 by the working surfaces 274-1, 274-2, 274-3. In at least one embodiment, the shared plane 276 may intersect the gage surface 289 of the bit 218.

Figure 10:
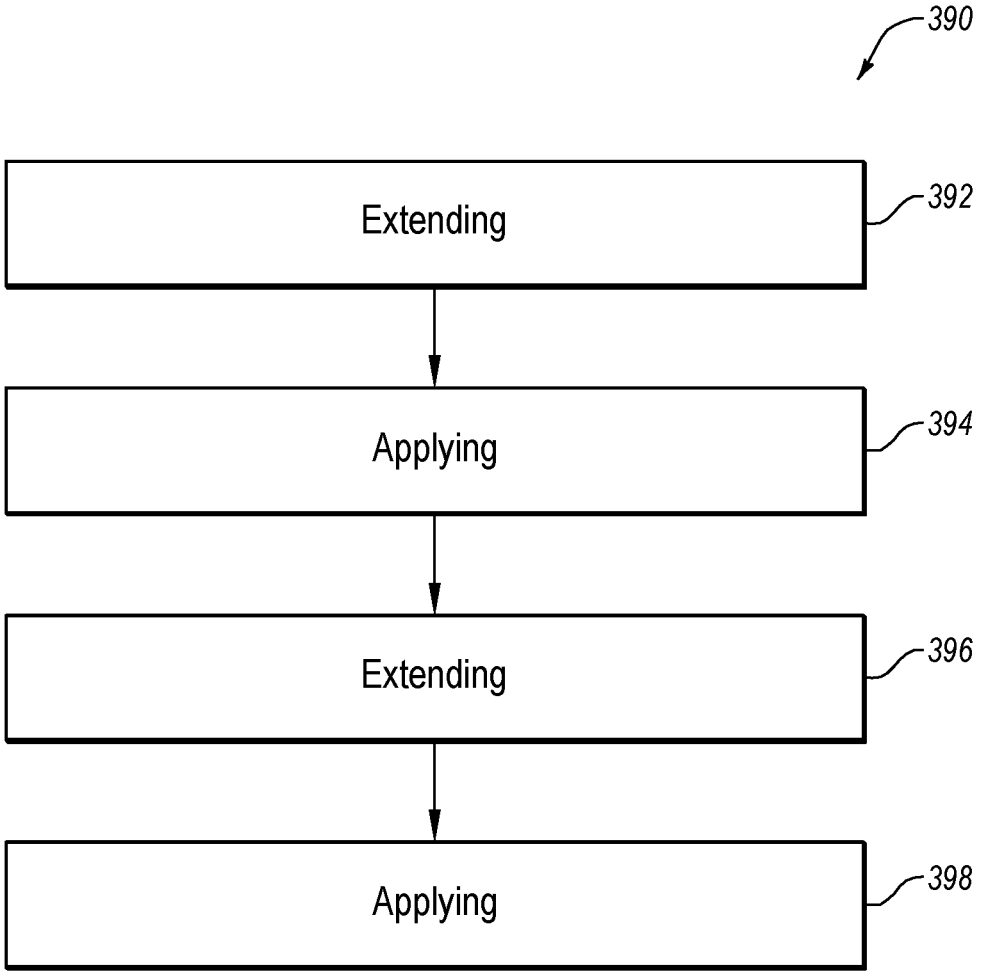
FIG. 10 is a flowchart illustrating an embodiment of a method of steering a drilling system.

FIG. 10 is a flowchart that illustrates an embodiment of a method 390 of steering a drilling system. The method 390 includes extending 392 a first actuator a first radial distance and applying 394 a first force to a formation. The method 390 further includes extending 396 a second actuator a second radial distance greater than the first radial distance and applying 398 a second force to the formation. The first radial distance is the distance from a radially outermost point of the first actuator to the longitudinal axis of the steering system. The second radial distance is the distance from a radially outermost point of the second actuator to the longitudinal axis of the steering system.

For example, when the first actuator is extended radially outward in the extended position, the first radial distance is the first extension length. In another example, when the second actuator is extended radially outward in the extended position, the second radial distance is the second extension length. In other embodiments, the first radial distance may be less than the first extension length. The second radial distance may be less than the second extension length.

In some embodiments, the working surface of the actuator applies the force to the formation. For example, the first force may be applied by a first working surface. The second force may be applied by a second working surface. In at least one embodiment, the method 390 may include retracting at least the first actuator after extending the first actuator the radial distance. Retracting the first actuator may include retracting the first actuator within a body of the steering system such that the first working surface is recessed from the outer surface of the body of the steering system.

The articles "a," "an," and "the" are intended to mean that there are one or more of the elements in the preceding descriptions. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Changes that come within the meaning and range of equivalency of the claims are to be embraced within their scope.

What is claimed is:

1. An actuator assembly comprising:

a body having a distal end and a proximal end with a longitudinal axis extending therebetween, the body including a wall with an outer surface at least partially oriented in a radial direction transverse to the longitudinal axis;

a first chamber formed in the wall and having an opening in the outer surface;

a first actuator positioned at least partially within the first chamber, the first actuator having a first working surface, the first actuator movable between an extended position and a retracted position, where the first working surface is radially further from the longitudinal axis in the extended position than in the retracted position, the first actuator having a first travel, wherein the first travel is a distance which the first actuator can extend from the body;

a second chamber formed in the wall and having an opening in the outer surface; and a second actuator positioned at least partially within the second chamber, the second actuator being longitudinally displaced in a proximal direction from the first actuator, the second actuator having a second working surface, the second actuator movable between an extended position and a retracted position, where the second working surface is radially further from the longitudinal axis in the extended position than in the retracted position, the second actuator having a second travel, wherein the second travel is a distance which the second actuator can extend from the body, and the second travel is greater than the first travel.

2. The actuator assembly of claim 1, wherein a profile of the first working surface is sloped radially inward in a distal direction.

3. The actuator assembly of claim 1, wherein a profile of the second working surface is sloped radially inward in a distal direction.

4. The actuator assembly of claim 1, wherein a second radially outermost point of the second working surface in the extended position is radially further from the longitudinal axis than a first radially outermost point of the first working surface when both are in the extended position.

5. The actuator assembly of claim 1, wherein the first actuator and second actuator are independently movable.

6. The actuator assembly of claim 1, wherein the first working surface is recessed from the outer surface when the first actuator is in the retracted position.

7. The actuator assembly of claim 1, wherein the first working surface and second working surface are within a shared plane when both are in the extended position, the shared plane being angled inward in a distal direction.

8. The actuator assembly of claim 7, wherein the body is a bit body and the shared plane intersects a gage surface of the bit body.

9. A rotary steerable system, the system comprising:

a body having a longitudinal axis extending between a distal end and a proximal end and an outer surface a radial distance from the longitudinal axis;

a first fluid channel at least partially positioned in the body;

a second fluid channel at least partially positioned in the body; and a first actuator assembly in the body including:

a first chamber formed in the body and having an opening in the outer surface, the first chamber being in fluid communication with the first fluid channel;

a first actuator positioned at least partially within the first chamber, the first actuator having a first working surface, the first actuator movable between an extended position and a retracted position, where the first working surface is radially further from the longitudinal axis in the extended position than in the retracted position and the first working surface is recessed from the outer surface in the retracted position, and the first actuator having a first travel, wherein the first travel is a distance which the first actuator can travel from the body;

a second chamber formed in the body and having an opening in the outer surface, the second chamber being longitudinally displaced in a proximal direction from the first chamber, the second chamber being in fluid communication with the second fluid channel; and a second actuator positioned at least partially within the second chamber, the second actuator having a second working surface, the second actuator movable between an extended position and a retracted position, where the second working surface is radially further from the longitudinal axis in the extended position than in the retracted position and the second working surface is recessed from the outer surface in the retracted position, the second actuator having a second travel, wherein the second travel is a distance which the second actuator can travel from the body, and the second travel is greater than the first travel.

10. The system of claim 9, wherein the first fluid channel and second fluid channel are in fluid communication with one another.

11. The system of claim 9, further comprising a hydraulic fluid in the first fluid channel.

12. The system of claim 9, wherein a profile of the first working surface is sloped radially inward in a distal direction, and a profile of the second working surface is sloped radially inward in the distal direction.

13. The system of claim 12, wherein a radially innermost point of the second working surface is radially further from the longitudinal axis than a radially outermost point of the first working surface.

14. The system of claim 9, further comprising a second actuator assembly in the body, the second actuator assembly being positioned radially opposing the first actuator assembly.

15. The system of claim 9, wherein the body is a bit body.

16. The system of claim 9, wherein the first actuator assembly further comprises a third actuator having a third travel that is greater than the second travel.

17. A method of steering a drilling system, the method comprising:

extending a downhole actuator of a rotary steerable system toward an extended position a first maximum travel distance from a longitudinal axis of the rotary steerable system;

applying a first force with the downhole actuator to a wellbore wall;

extending an uphole actuator of the rotary steerable system toward a second extended position a second maximum travel distance from the longitudinal axis of the rotary steerable system, wherein the second radial maximum travel distance is greater than the first maximum travel distance; and applying a second force with the uphole actuator to the wellbore wall.

18. The method of claim 17, wherein applying the first force includes contacting the wellbore wall with a working surface of the uphole actuator.

19. The method of claim 17, wherein extending the uphole actuator occurs at a different time than applying the first force with the downhole actuator.

20. The method of claim 17, further comprising retracting the downhole actuator toward a retracted position.

* * * * *